US005673885A

United States Patent [19]

Pham

[11] Patent Number: 5,673,885

[45] Date of Patent: Oct. 7, 1997

[54] PAINT TRAY FOR A STEPLADDER

[76] Inventor: Paul Pham, 2021 S. Highway 288B, Angleton, Tex. 77515

[21] Appl. No.: 580,455

[22] Filed: Dec. 27, 1995

[51] Int. Cl.[6] ..... E06C 7/14

[52] U.S. Cl. ..... 248/210; 248/238; 248/231.41; 211/70.6; 182/129

[58] Field of Search ..... 248/210, 228.3, 248/238, 231.41, 441.1; 211/70.6, 86; 182/129

[56] References Cited

U.S. PATENT DOCUMENTS

| | | | |
|---|---|---|---|
| 1,704,122 | 3/1929 | Cohen | 211/70.6 X |
| 2,240,842 | 5/1941 | Gehring et al. | 211/70.6 X |
| 2,308,180 | 1/1943 | Larsen et al. | 248/238 |
| 2,444,584 | 7/1948 | Touchett . | |
| 2,473,951 | 6/1949 | Hickey | 248/210 X |
| 2,541,434 | 2/1951 | Nelson et al. | 248/210 |
| 2,912,114 | 11/1959 | Levitt | 211/86 X |
| 3,053,494 | 9/1962 | Stoll | 248/228.3 |
| 3,642,239 | 2/1972 | Zeiler, Jr. | 248/210 |
| 4,383,669 | 5/1983 | Rasler | 248/210 |
| 4,480,810 | 11/1984 | Hall | 248/238 |
| 4,706,918 | 11/1987 | Wilson | 248/210 |
| 4,874,147 | 10/1989 | Ory et al. | 248/210 |
| 5,028,048 | 7/1991 | Watson et al. | 248/441.1 X |
| 5,093,052 | 3/1992 | Beck | 248/238 |
| 5,333,823 | 8/1994 | Joseph | 248/210 X |
| 5,511,753 | 4/1996 | Lage | 248/238 |

*Primary Examiner*—Leslie A. Braun
*Assistant Examiner*—Stephen S. Wentsler
*Attorney, Agent, or Firm*—Michael I. Kroll

[57] ABSTRACT

A paint tray (10) for a stepladder (12) which comprises a structure (14) for storing work materials (16), tools (18) and a paint bucket (20) in an organized manner, so that a person can conveniently utilize the work materials (16), tools (18) and paint bucket (20) therefrom. A facility (22) is for retaining the storing structure (14) to the stepladder (12) in a safe dependable manner, so that the work materials (16), tools (18) and paint bucket (20) are maintained within the storing structure (14), while the storing structure (14) will be firmly held in place onto the stepladder (12) by the retaining facility (22).

16 Claims, 3 Drawing Sheets

PAINT TRAY FOR A STEPLADDER

BACKGROUND OF THE INVENTION

1. Field of the Invention

The instant invention relates generally to trays and more specifically it relates to a paint tray for a stepladder.

2. Description of the Prior Art

Numerous trays have been provided in prior art. For example, U.S. Pat. Nos. 2,444,584 to Touchett; 2,473,951 to Hickey; 3,642,239 to Zeiler, Jr. and 4,383,669 to Rasler all are illustrative of such prior art. While these units may be suitable for the particular purpose to which they address, they would not be as suitable for the purposes of the present invention as heretofore described.

TOUCHETTE, LAWRENCE PAUL

SLOPING BOTTOM TRAY AND SUPPORT STRUCTURE

U.S. Pat. No. 2,444,584

A tray comprising a shallow, open-topped substantially rectangular receptacle having a bottom sloping from one end of the receptacle to the other so that one end is deeper than the other. A foot portion is secured to the end portion of the receptacle of least depth and projects downwardly an extent such that the lower edge thereof is vertically spaced from the upper edge of the receptacle a distance substantially equal to the depth of the opposite end portion of the receptacle. The foot and the opposite end of the receptacle may support the receptacle with the top edges thereof substantially horizontal. A ledge projects in from the foot portion to underlie the bottom of the receptacle and forms a hook adapted to engage under a support, like the step or top of a stepladder, to hold the receptacle thereon with its portion of least depth over the support, and its portion of greater depth projecting therebeyond.

HICKEY, MARVIN M.

STEPLADDER TRAY OR SHELF

U.S. Pat. No. 2,473,951

A tray for attachment to a step of a step ladder comprising a rectangular bottom. A continuous flange about the bottom forms a tray. The bottom is adapted to rest upon the upper surface of the step substantially lengthwise of the same. The bottom has a pair of spaced openings transversely spaced in a plane medial of the bottom and perpendicular to the longitudinal axis of the bottom portion. Each of the openings is adjacent the flange. Bolts go through the openings. A clamping bar is adapted to engage the lower surface of the step and to receive one of the bolts. The bar is pivotally mounted on one bolt for swinging the bar relative to the other bolts. The clamping bar has a slot therein, spaced from the first bolt which is adapted to receive the other bolts. Clamping nuts are on the bolts whereby the clamping bar and tray may be clamped to the step.

ZEILER, JR., ELMER J.

CONTAINER SUPPORT AND ATTACHMENT MEANS

U.S. Pat. No. 3,642,239

A planar rectangular base member has depending flanges on two opposite sides thereof terminating in spaced opposing inturned flanges to embrace a support for the base member. An upstanding continuous flange encloses the top face of the base member. Two spaced concentric upstanding hollow ring members are secured to the top face for receiving and supporting annular containers therein, such as paint cans. The outer of the concentric ring members extends above the inner ring member and receives an annular container to be supported upon the face of the inner ring member. The invention is intended for detachable mounting upon the folding shelf of the conventional stepladder to securely retain paint cans in place and prevent accidental displacement thereof during painting.

RASLER, RAYMOND E.

INVERTIBLE DUAL CARRIER FOR LADDER-TOP USE

U.S. Pat. No. 4,383,669

A carrier for tools, painters' supplies and the like, for use on the top of a folding ladder, is invertible, providing a selection between two tray-like receptacles of different depths having a common planar bottom which rests on the ladder top. The rectangular wall of the inverted tray portion holds the carrier securely on the ladder top. Handles, drawn upward to whichever side is presented upward and then inward, spring back and retract out of the way by gravity.

SUMMARY OF THE INVENTION

A primary object of the present invention is to provide a paint tray for a stepladder that will overcome the shortcomings of the prior art devices.

Another object is to provide a paint tray for a stepladder which includes an open top container that will hold work materials, tools and a paint bucket in an organized manner, so that a person can conveniently utilize the work materials, tools and paint bucket therefrom.

An additional object is to provide a paint tray for a stepladder in which the open top container can be clamped to a stepladder in a safe dependable manner, so that the work materials, tools and paint bucket will be maintained within the open top container that is firmly held in place onto the stepladder.

A further object is to provide a paint tray for a stepladder that is simple and easy to use.

A still further object is to provide a paint tray for a stepladder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
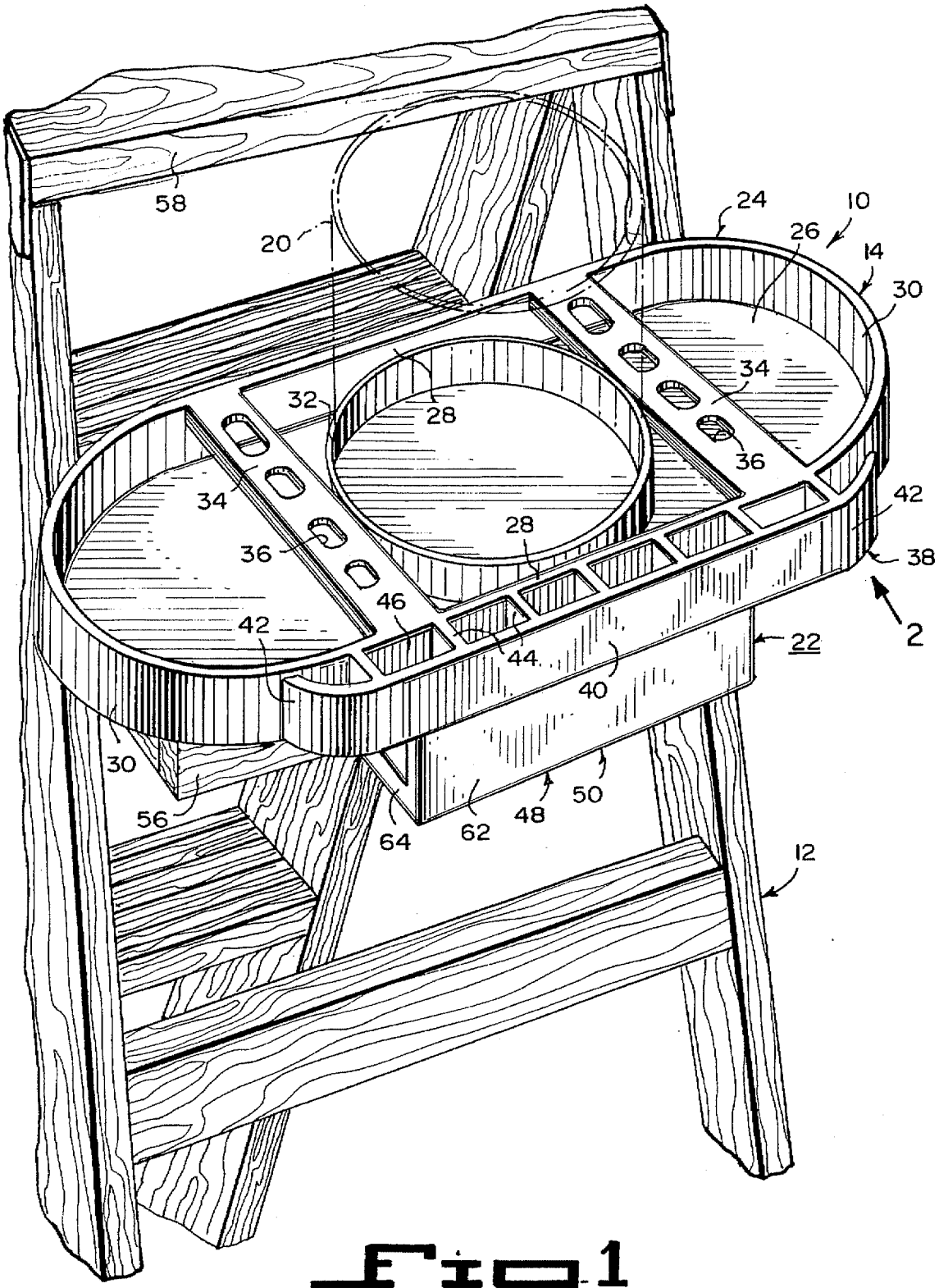
FIG. 1 is a top perspective view of the instant invention clamped onto the pail rest of a stepladder.
Figure 2:
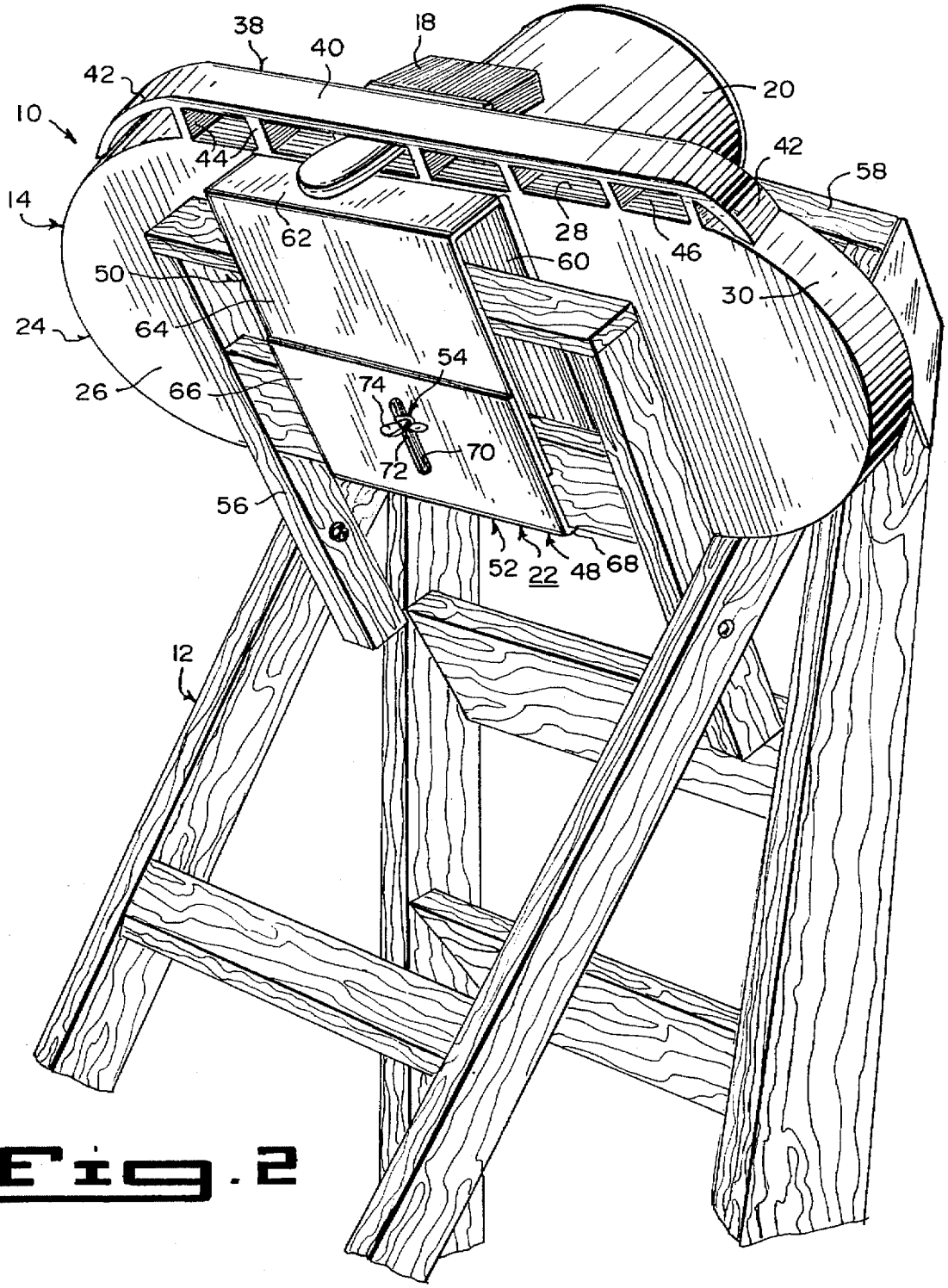
FIG. 2 is a bottom perspective view taken in the direction of arrow 2 in FIG. 1.
Figure 3:
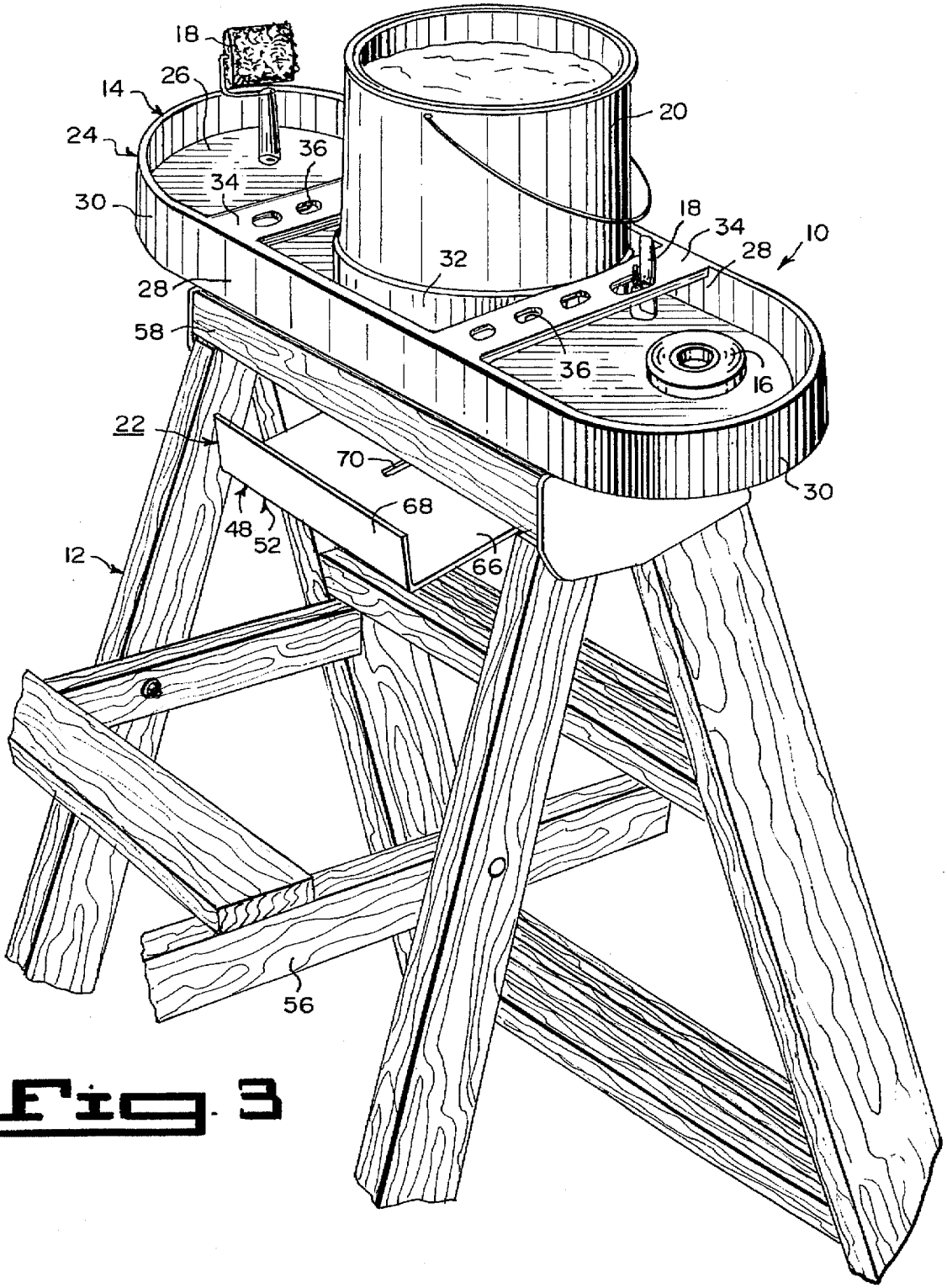
FIG. 3 is a top perspective view of the instant invention ready to be clamped onto the head step of the stepladder.

Turning now descriptively to the drawings, in which similar reference characters denote similar elements throughout the several views, FIGS. 1 through 3 illustrate a paint tray 10 for a stepladder 12 which comprises a structure 14 for storing work materials 16, tools 18 and a paint bucket 20 in an organized manner, so that a person can conveniently utilize the work materials 16, tools 18 and paint bucket 20 therefrom. A facility 22 is for retaining the storing structure 14 to the stepladder 12 in a safe dependable manner, so that the work materials 16, tools 18 and paint bucket 20 are maintained within the storing structure 14, while the storing structure 14 will be firmly held in place onto the stepladder 12, by the retaining facility 22.

The storing structure 14 is an open top container 24. The open top container 24 includes an oval base member 26 enclosed by a pair of upstanding rigid straight side walls 28 and by a pair of upstanding rigid curved end walls 30, to store the work materials 16 and tools 18 therein.

An upstanding annular flange 32 is centrally affixed upon the oval base member 26, to maintain the paint bucket 20 therein. A pair of crossbars 34 are provided having a plurality of apertures 36. Each crossbar 34 extends between top edges of the side walls 28 on an opposite side of the annular flange 32 to store some of the tools 18 within the apertures 36.

A tool rack 38, as shown in FIGS. 1 and 2, can be integrally formed onto the forward side wall 28 of the open top container 24, to store some of the tools 18 therein. The tool rack 38 consists of a straight front plate 40 having curved ends 42. A plurality of partition walls 44 are spaced apart and integrally extend between the front plate 40 and the forward side wall 28 of the open top container 34, so as to form a plurality of chambers 46 to store some of the tools 18 therein.

The retaining facility 22 is an adjustable clamp 48 affixed to a bottom surface of the storing structure 14. The adjustable clamp 48 contains a first bracket member 50 affixed to the bottom surface of the storing structure 14. A second bracket member 52 is provided. An assemblage 54 is for connecting the second bracket member 52 to the first bracket member 50 in a movable manner. The first bracket member 50 with the second bracket member 52 can in a first instance, clamp onto a pail rest 56 of the stepladder 12, as shown in FIGS. 1 and 2, and in a second instance, clamp onto a head step 58 of the stepladder 12, as shown in FIG. 3.

The first bracket member 50 includes a first panel 60 affixed horizontally to the bottom surface of the storing structure 14. A second panel 62 extends vertically downward from the forward edge of the first panel 60. A third panel 64 extends horizontally form a bottom edge of the second panel 62 below the first panel 60.

The second bracket member 52 contains a first plate 66 horizontally positioned to overhang against the third panel 64 of the first bracket member 50. A second plate 68 extends vertically upward from a rear edge of the first plate 66 away from the second panel 62 of the first bracket member 50.

The connecting assemblage 54 consists of the first plate 66 of the second bracket member 52 having a longitudinal slot 70 therethrough. A bolt having a threaded shaft 72 extends through the third panel 64 of the first bracket member 50 and the longitudinal slot 70 in the first plate 66 of the second bracket member 54. A wing nut 74 is threaded upon the threaded shaft of the bolt 72, so as to lock the first plate 66 of the second bracket member 52 to the third panel 64 of the first bracket member 50.

LIST OF REFERENCE NUMBERS

10 paint tray
12 stepladder
14 storing structure of 10
16 work material
18 tool
20 paint bucket
22 retaining facility of 10
24 open top container for 14
26 oval base member of 24
28 upstanding rigid straight side wall of 24
30 upstanding rigid curved end wall of 24
32 upstanding annular flange of 24
34 crossbar of 10
36 aperture in 34
38 tool rack of 10
40 straight front plate of 38
42 curved end of 40
44 partition wall of 38
46 chamber in 38
48 adjustable clamp for 22
50 first bracket member of 48
52 second bracket member of 48
54 connecting assemblage of 48
56 pail rest of 12
58 head step of 12
60 first panel of 50
62 second panel of 50
64 third panel of 50
66 first plate of 52
68 second plate of 52
70 longitudinal slot in 66 of 54
72 bolt with threaded shaft of 54
74 wing nut of 54

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A paint tray for a stepladder which comprises means for storing work materials, tools and a paint bucket in an organized manner, so that a person can conveniently utilize the work materials, tools and paint bucket therefrom, said storing means including:

a) an open top container having an oval base member enclosed by a pair of upstanding rigid straight side walls and a pair of upstanding rigid curved end walls to store the work materials and tools therein;

b) an upstanding annular flange centrally affixed upon said oval base member to maintain the paint bucket therein; and c) a pair of crossbars having a plurality of apertures, in which each said crossbar extends between top edges of said side walls on an opposite side of said annular flange to store some of the tools within the apertures.

2. A paint tray for a stepladder as recited in claim 1, further including means for retaining said storing means to the stepladder in a safe dependable manner, so that the work materials, tools and paint bucket are maintained within said storing means, while said storing means will be firmly held in place onto the stepladder by said retaining means.

3. A paint tray for a stepladder as recited in claim 2, wherein said retaining means is an adjustable clamp affixed to a bottom surface of said storing means.

4. A paint tray for a stepladder as recited in claim 3, wherein said adjustable clamp includes:

a) a first bracket member affixed to the bottom surface of said storing means;

b) a second bracket member; and c) means for connecting said second bracket member to said first bracket member in a movable manner, so that said first bracket member with said second bracket member can in a first instance, clamp onto a pail rest of the stepladder and in a second instance, clamp onto a head step of the stepladder.

5. A paint tray for a stepladder as recited in claim 4, wherein said first bracket member includes:

a) a first panel affixed horizontally to the bottom surface of said storing means;

b) a second panel extending vertically downward from a forward edge of said first panel; and c) a third panel extending horizontally from a bottom edge of said second panel below said first panel.

6. A paint tray for a stepladder as recited in claim 5, wherein said second bracket member includes:

a) a first plate horizontally positioned to overhang against said third panel of said first bracket member; and b) a second plate extending vertically upward from a rear edge of said first plate away from said second panel of said first bracket member.

7. A paint tray for a stepladder as recited in claim 6, wherein said connecting means includes:

a) said first plate of said second bracket member having a longitudinal slot therethrough;

b) a bolt having a threaded shaft extending through said third panel of said first bracket member and said longitudinal slot in said first plate of said second bracket member; and c) a wing nut threaded upon said threaded shaft of said bolt, so as to lock said first plate of said second bracket member to said third panel of said first bracket member.

8. A paint tray for a stepladder as recited in claim 2, further including a tool rack integrally formed onto a forward side wall of said open top container, to store some of the tools therein.

9. A paint tray for a stepladder as recited in claim 8, wherein said tool rack includes:

a) a straight front plate having curved ends; and b) a plurality of partition walls spaced apart and integrally extending between said front plate and said forward side wall of said open top container, so as to form a plurality of chambers to store some of the tools therein.

10. A paint tray for a stepladder as recited in claim 9, wherein said retaining means is an adjustable clamp affixed to a bottom surface of said storing means.

11. A paint tray for a stepladder as recited in claim 10, wherein said adjustable clamp includes:

a) a first bracket member affixed to the bottom surface of said storing means;

b) a second bracket member; and c) means for connecting said second bracket member to said first bracket member in a movable manner, so that said first bracket member with said second bracket member can in a first instance, clamp onto a pail rest of the stepladder and in a second instance, clamp onto a head step of the stepladder.

12. A paint tray for a stepladder as recited in claim 11, wherein said first bracket member includes:

a) a first panel affixed horizontally to the bottom surface of said storing means;

b) a second panel extending vertically downward from a forward edge of said first panel; and c) a third panel extending horizontally from a bottom edge of said second panel below said first panel.

13. A paint tray for a stepladder as recited in claim 12, wherein said second bracket member includes:

a) a first plate horizontally positioned to overhang against said third panel of said first bracket member; and b) a second plate extending vertically upward from a rear edge of said first plate away from said second panel of said first bracket member.

14. A paint tray for a stepladder as recited in claim 13, wherein said connecting means includes:

a) said first plate of said second bracket member having a longitudinal slot therethrough;

b) a bolt having a threaded shaft extending through said third panel of said first bracket member and said longitudinal slot in said first plate of said second bracket member; and c) a wing nut threaded upon said threaded shaft of said bolt, so as to lock said first plate of said second bracket member to said third panel of said first bracket member.

15. A paint tray for a stepladder as recited in claim 1, further including a tool rack integrally formed onto a forward side wall of said open top container, to store some of the tools therein.

16. A paint tray for a stepladder as recited in claim 15, wherein said tool rack includes:

a) a straight front plate having curved ends; and b) a plurality of partition walls spaced apart and integrally extending between said front plate and said forward side wall of said open top container, so as to form a plurality of chambers to store some of the tools therein.

* * * * *